US007938953B2

(12) United States Patent
Colyar et al.

(10) Patent No.: US 7,938,953 B2
(45) Date of Patent: May 10, 2011

(54) SELECTIVE HEAVY GAS OIL RECYCLE FOR OPTIMAL INTEGRATION OF HEAVY OIL CONVERSION AND VACUUM GAS OIL TREATING

(75) Inventors: James J. Colyar, Newtown, PA (US); John Duddy, Langhorne, PA (US)

(73) Assignee: Institute Francais du Petrole, Rueil-Malmaison (FR)

( * ) Notice: Subject to any disclaimer, the term of this patent is extended or adjusted under 35 U.S.C. 154(b) by 423 days.

(21) Appl. No.: 12/154,011

(22) Filed: May 20, 2008

(65) Prior Publication Data

US 2009/0288984 A1 Nov. 26, 2009

(51) Int. Cl.
*C10G 65/00* (2006.01)

(52) U.S. Cl. ..... 208/59; 208/58; 208/49

(58) Field of Classification Search ..... 208/49, 208/58

See application file for complete search history.

(56) References Cited

U.S. PATENT DOCUMENTS

| | | | | |
|---|---|---|---|---|
| 4,045,329 A | | 8/1977 | Johanson | |
| 5,108,580 A | * | 4/1992 | Nongbri et al. | 208/61 |
| 5,320,745 A | * | 6/1994 | Cook et al. | 208/61 |
| 6,004,453 A | | 12/1999 | Benham | |

* cited by examiner

*Primary Examiner* — Glenn A Caldarola
*Assistant Examiner* — Michelle L Stein
(74) *Attorney, Agent, or Firm* — John F. Ritter

(57) ABSTRACT

An improved process for heavy oil conversion and upgrading and a combined method for heavy oil conversion and vacuum gas-oil treatment are described herein. The method utilizes the creation and recycle of a separate product from the vacuum still, which is thereafter recycled back to the heavy oil conversion reactor. The result is the production of a higher quality medium gas oil product relative to the overall vacuum gas oil product which is acceptable for use in a typical vacuum gas oil treatment process. Additionally, there is a higher diesel yield selectivity from the heavy oil conversion unit.

3 Claims, 1 Drawing Sheet

SELECTIVE HEAVY GAS OIL RECYCLE FOR OPTIMAL INTEGRATION OF HEAVY OIL CONVERSION AND VACUUM GAS OIL TREATING

BACKGROUND OF THE INVENTION

Hydrocarbon compounds are useful for a number of purposes. In particular, hydrocarbon compounds are useful as fuels, solvents, degreasers, cleaning agents, and polymer precursors. The most important source of hydrocarbon compounds is petroleum crude oil. Refining of crude oil into separate hydrocarbon compound fractions is a well-known processing technique.

Generally speaking, a refinery receives the incoming crude oil and produces a variety of different hydrocarbon products in the following manner. The crude product is initially introduced to a crude tower, where it is separated into a variety of different components including naphtha, diesel, and atmospheric bottoms (those that boil above approximately 650° F.).

The atmospheric bottoms from the crude tower is thereafter sent for further processing to a vacuum still, where it is further separated into a heavy vacuum resid stream (e.g. boiling above 1050° F.) and a vacuum gas oil (VGO) stream (nominally boiling between 650° F. and 1050° F.). At this point the heavy vacuum resid product can be further treated to remove unwanted impurities or converted into useful hydrocarbon products.

To treat the vacuum residue stream, ebullated-bed technologies have been developed and sold, which have numerous advantages in performance and efficiency, particularly with heavy crudes. This process is generally described in U.S. Pat. No. Re 25,770 to Johanson incorporated herein by reference. The treatment of vacuum residues generally involves conversion to lighter boiling products with upgrading (contaminant reduction) of the conversion products and unconverted vacuum residue.

The ebullated-bed process comprises the passing of concurrently flowing streams of liquids or slurries of liquids and solids and gas through a vertically cylindrical vessel containing catalyst. The catalyst is placed in motion in the liquid and has a gross volume dispersed through the liquid medium greater than the volume of the mass when stationary. This technology is utilized in the upgrading of heavy liquid hydrocarbons typical vacuum residue or converting coal to synthetic oils.

The invention described herein is an improved scheme which optimally integrates heavy oil conversion/upgrading of vacuum residue and hydrotreating/hydrocracking of the conversion process vacuum gas oil. The invention may be applied to a wide range of applications including ebullated-bed reactor systems, fixed-bed systems, dispersed catalyst slurry reaction systems, and combinations thereof, including, but not limited to, petroleum atmospheric or vacuum residua, coal, lignite, hydrocarbon waste streams, or combinations thereof.

The invention comprises the creation and recycle of a selective product vacuum still product (heavy-heavy vacuum gas oil or HHVGO) back to the heavy oil conversion reactor. The recycle is a selective fraction, typically boiling in the 850-1050° F. boiling range and contains the majority of the critical contaminants including, CCR and heptane insolubles in the overall VGO product.

The remaining VGO, which is routed to a hydrotreater or hydrocracker, has significantly lower CCR and asphaltenes and is therefore easier to process. The vacuum still in this invention which separates the conversion of step products, will typically have four products including (in order of boiling range): LVGO—light vacuum gas oil; MVGO—medium vacuum gas oil; HHVGO—heavy vacuum gas oil; and vacuum bottoms—residue. The MVGO will also have less vacuum residue, which is a primary contributor to hydrotreater catalyst deactivation.

The HHVGO stream is thereafter processed, including cracking and hydrogenation when recycled back to the heavy oil conversion reactor, with the net vacuum still gas oil products consisting of LVGO, MVGO, and diesel boiling range product.

SUMMARY OF THE INVENTION

The objective of this invention is to provide a novel process configuration reactor design for optimally treating heavy vacuum residue feeds while producing an acceptable feedstock for hydrotreatment/hydrocracking of the vacuum gas oil (VGO) conversion product.

Novel features of this invention include the production, via vacuum separation, of a separate HHVGO product from the heavy oil conversion process vacuum still resulting in the production of light and medium vacuum gas oil products. This MVGO will have improved quality and acceptable for typical vacuum oil treatment processes and a minimal risk of having undesirable entrained vacuum residue in the VGO treater feed.

Another novelty of the invention is the recycle of the HHVGO stream to the conversion reactor, preferably to extinction, which results in higher valuable diesel yield selectivity from the heavy oil conversion unit.

The invention may further be described as follows: in a process of heavy vacuum residue conversion/upgrading and vacuum gas oil treating wherein vacuum residue feedstock is first processed through a heavy oil conversion upgrading unit to create a heavy vacuum gas oil (HVGO) stream for further hydrotreatment, an improvement comprising:

separating a portion of said heavy vacuum gas oil stream to create a heavy, heavy vacuum gas oil (HHVGO) stream, said HHVGO stream having greater than 90% boiling in the 850-1050° F. range, which is thereafter recycled back to the heavy oil conversion upgrading unit.

The recycle results in the conversion of the HHVGO with a higher net diesel yield and the feeding of a lighter, easier to process MVGO product, to the downstream VGO hydrotreatment unit. The invention therefore accomplishes a more desirable yield selectivity from the heavy oil conversion unit and a more economic and efficient vacuum gas oil treatment unit.

More precisely, the invention is relative to a process of heavy vacuum residue conversion and vacuum gas oil treating wherein vacuum residue feedstock is first processed through a heavy oil conversion step said process comprising:

vacuum separation of the effluent from said conversion step to obtain a heavy, heavy vacuum gas oil (HHVGO) stream, said HHVGO stream having greater than 90% wt boiling in the 840-1050° F. range, a fraction of which is thereafter recycled back to the heavy oil conversion and hydrotreatment of said HHVGO.

In an advantageous embodiment, in the vacuum separation are also obtained a light vacuum gasoil (LVGO) in which 90-100% wt are boiling below 1000° F., a medium vacuum gasoil (MVGO) and vacuum bottoms product, and at least a fraction of said LVGO and/or MVGO is hydrotreated, and optionally at least a fraction of said vacuum bottoms is recycled to the heavy oil conversion step.

A preferred process for atmospheric or vacuum residue conversion comprises:

a) providing atmospheric or vacuum residue to a heavy oil conversion reactor, at least 40% of said atmospheric or vacuum residue boiling above 1000° F. and said reactor operating at reaction conditions of 750°-850° F. temperature, 0.10 to 3.0 liquid hourly space velocity, and 1000-3000 PSIA inlet hydrogen partial pressure and separating the effluent in a full-range ($C_5^+$) converted effluent and an unconverted residue effluent (boiling above 650° F.);

b) passing said unconverted residue to a vacuum still to separate said unconverted residue into vacuum gas oil streams comprising a light vacuum gas oil stream (LVGO), a medium vacuum gas oil stream (MVGO), a heavy, heavy vacuum gas oil stream (HHVGO) boiling between 850°-1050° F., and a vacuum residue stream (1050° F.+);

c) hydrotreating or hydrocracking said light vacuum gas oil stream and medium vacuum gas oil stream;

d) recycling at least a portion of said HHVGO stream along with optional unconverted vacuum residue stream to said heavy oil conversion reactor; and e) said recycle of the HHVGO results in a higher yield selectivity from the heavy oil conversion and a greatly improved feedstock quality to said VGO hydrotreater or hydrocracker, regarding to the same process without recycle of the HHVGO.

BRIEF DESCRIPTION OF THE DRAWINGS

This invention will be described further with reference to the following drawing in which.

DETAILED DESCRIPTION OF THE DRAWINGS

Figure 1:
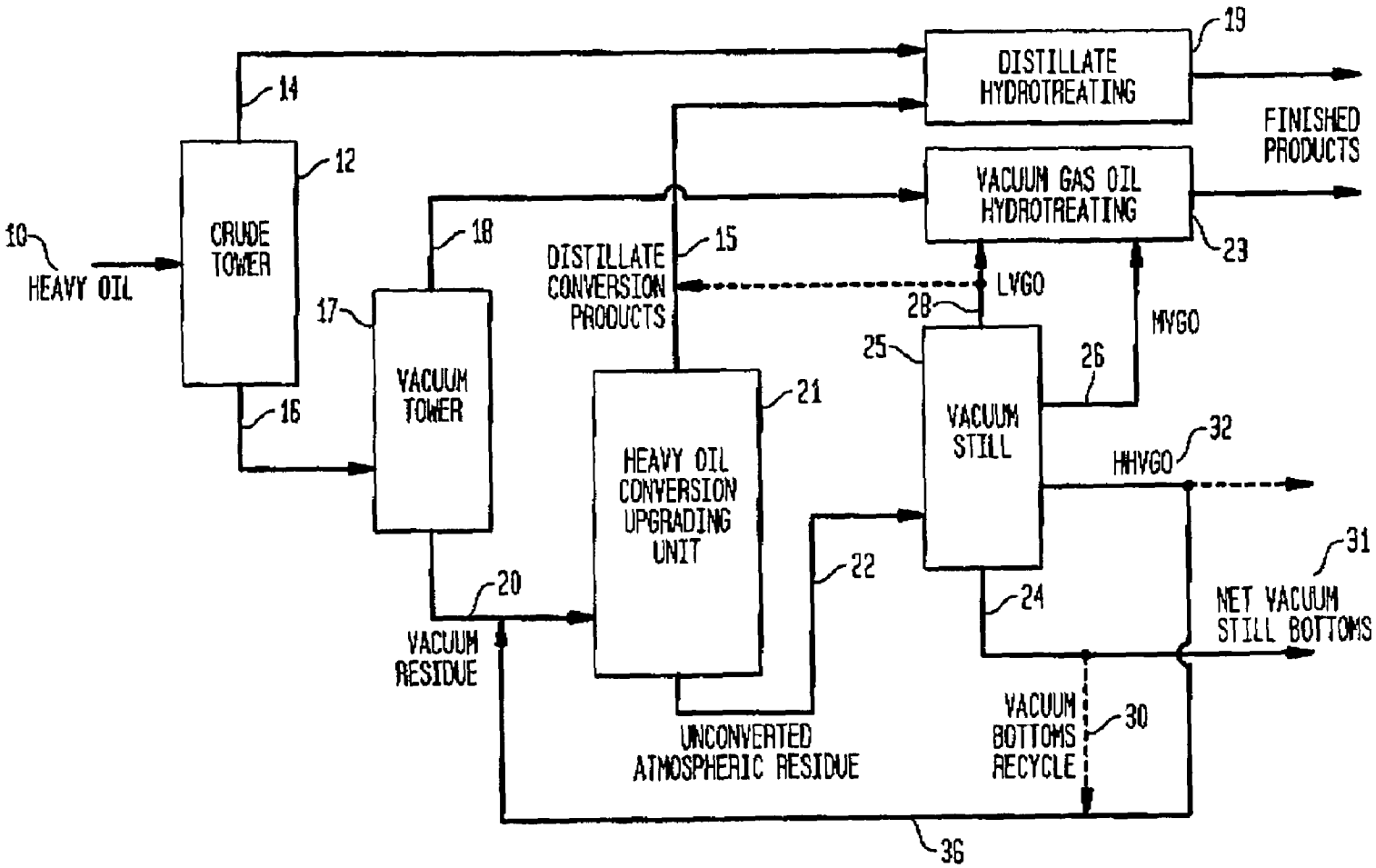
FIG. 1 is a schematic flowsheet of an integrated process with the novel features of the invention described therein.

FIG. 1 shows a detailed schematic flowsheet of the invention. The heavy oil feed stream 10 is initially introduced to a crude fractionation tower 12, where it is separated into a variety of different components including distillates and atmospheric bottoms (boil above 650° F.).

The distillates 14 from the crude tower 12 are thereafter sent to a hydrotreater 19 for additional hydrogenation and removal of heteroatoms. The atmospheric bottoms stream 16 from the crude tower 12 is thereafter sent for further processing to a crude vacuum still or tower 17, where it is further separated into a heavy vacuum resid stream (e.g. boiling above approximately 1000° F.) 20 and a vacuum gas oil (VGO) stream 18 (boiling between 650° F. and 1000° F.). The heavy vacuum resid stream 20 can be treated to remove unwanted impurities and converted into useful hydrocarbon products.

The vacuum gas oil stream 18 from the vacuum tower 17 is sent to a vacuum gas oil hydrotreater 23 where the VGO stream is further processed in order to yield a usable hydrocarbon product. This further processing may comprise some conversion of the VGO feedstock to diesel (boiling between 400° F. and 650° F.) as well as some cleaning hydrotreatment prior to its typical final processing in the Fluid Catalytic Cracker ("FCC") Unit (not pictured), where it is converted into gasoline and diesel fuels.

The vacuum residue stream 20 from the vacuum tower 17 is sent to a heavy oil conversion upgrading unit 21. Although the heavy oil conversion upgrading unit 21 can be an ebullated-bed reactor, a fixed-bed reactor, dispersed catalyst slurry reaction systems or combinations thereof, it may be preferable to employ an ebullated-bed system because of its applicability to heavy grade feedstocks.

The heavy oil conversion upgrading unit 21 creates a distillate stream 15 which is thereafter sent to a hydrotreater for further hydrogenation and removal of heteroatoms and an unconverted atmospheric residue stream 22, containing approximately 90% having boiling point of greater than 650° F. which is thereafter sent to a product vacuum still 25.

Typically, the gross VGO product from the vacuum still is thereafter sent to a vacuum gas oil hydrotreater/hydrocracker. This gross VGO product typically contains a relatively high content of heptane insolubles, CCR, polynuclear aromatics (PNAs), and contaminant metals. Such materials are well-known deactivators of VGO hydrotreating and hydrocracking catalysts. Moreover, the nature of these materials causes the VGO treatment reactor to have a greater volume and operate at greater pressures than would be necessary with a cleaner feed, thus substantially driving up investment and operating costs.

However, in the process of the present invention, the vacuum still 25 is utilized to create multiple product streams for processing. The vacuum still 25 separates the unconverted atmospheric product into a light vacuum gas oil 28 LVGO (90-100% boiling below 1000° F.), a medium vacuum gas oil MVGO 26, and a heavy-heavy vacuum gas oil stream (HHVGO) 32 and a vacuum bottoms product. The net VGO product, which is the combination of LVGO and MVGO, may be one stream or, as shown in FIG. 1, can be further separated in the vacuum still into a light vacuum gas oil stream (LVGO) 28 which can thereafter be routed to a distillate hydrotreater 19 and a medium vacuum gas oil stream (MVGO) 26 which is thereafter sent to a vacuum gas oil hydrotreater/hydrocracker 23.

The removal of the HHVGO 32 from the overall VGO product greatly improves the quality of the VGO hydrotreater/hydrocracker 23 feedstock by reducing the level of aforementioned contaminants in the stream. Additionally, a large fraction of the HHVGO stream 32 is thereafter combined, along with possible vacuum bottoms recycle 30 from the vacuum still 25 to form a total recycle stream 36 back to the heavy oil conversion unit reactor 21, thus reducing the VGO hydrotreater/hydrocracker 23 feed rate and therefore substantially reducing the overall configuration investment cost.

As previously mentioned, a portion of the vacuum bottoms 24 from the vacuum still 25 can be recycled back to the heavy oil conversion upgrading unit 21 for additional vacuum residue conversion with the net vacuum still bottoms 31 typically routed to heavy fuel oil or to a coker or solvent deasphalter (SDA) unit (not shown).

This invention will be further described by the following example, which should not be construed as limiting the scope of the invention.

EXAMPLE 1

To demonstrate the process and economic advantages of this invention, two ebullated-bed reactor cases with downstream VGO hydrotreating have been developed and are presented below. In case 1, there was no separate HHVGO stream from the product vacuum tower. In case 2, which illustrates the current invention, a HHVGO stream was recovered from the vacuum tower and a portion thereof was recycled to a heavy oil conversion upgrading unit. Both cases operate at the identical level of vacuum residue conversion as indicated by the same rate of vacuum bottoms product in Table 2. The operating conditions and feedstock analyses for the comparative cases are listed in Tables 1 and 2 below.

The example involves the processing of 200 tons per hour of vacuum residue feed to the heavy oil conversion unit. The net conversion of material boiling greater than 1050° F.$^+$ is 78 W %.

In case 2, 28 TPH or approximately 14% recycle (based on fresh feed) of HHVGO is sent to the heavy oil conversion reactors. Much of this HHVGO selective fraction is converted to lighter material in the reactor. There is a small purge of the net HHVGO product from the heavy oil conversion vacuum still.

TABLE 1

| Operating Conditions | | |
|---|---|---|
| | Case 1 | Case 2 (Present Invention) |
| | No HHVGO Recycle | HHVGO Recycle |
| Vacuum Residue Feed to Heavy Oil Conversion Unit, ton/hr | 200 | 200 |
| Vacuum Residue Conversion % | 78 | 78 |
| Recycle Rate of HHVGO, ton/hr | 0 | 28 |
| **Feed to VGO Hydrotreater** | | |
| Components | LVGO + MVGO + HHVGO | LVGO + MVGO |
| Rate, ton/hr | 71.1 | 54.5 |

TABLE 2

| Heavy Oil Conversion Unit Yields TPH (% Conversion Product) | | |
|---|---|---|
| | Case 1 No HHVGO Recycle | Case 2 (Present Invention) HHVGO Product and Recycle |
| Naphtha + Fractionation OVHD | 23.2 (15) | 24.5 (16) |
| Diesel | 60.4 (39) | 67.5 (44) |
| Total Net VGO | 71.1 (46) | 61.1[1] (40) |
| Vacuum Residue | 38.8 (19) | 38.8 (19) |
| Total | 193.5 (97) | 192.2 (96) |

[1]Includes LVGO, MVGO, and a small quantity of net HHVGO

TABLE 3

| VGO Hydrotreater Feed Quality and Operation | | |
|---|---|---|
| Feedstock Quality Feed Components | Total VGO[1] | MVGO + LVGO |
| Feedrate, TPH | 71.1 | 54.5 |
| Gravity, ° API | 17.9 | 18.2 |
| $C_7$ Asphaltenes, wppm | ~1000 | <200 |
| CCR, W % | 0.9 | 0.5 |
| Nickel + Vanadium, wppm | 4 | 2 |
| Boiling Distribution, W % (ASTM D1160) | | |
| IBP-712° F. | 16.7 | 10.0 |
| 712° F.-932° F. | 58.7 | 80.0 |
| 932° F.-1050° F. | 19.9 | 10.0 |
| 1050° F.$^+$ | 4.7 | 0.0 |

TABLE 3-continued

| VGO Hydrotreater Feed Quality and Operation | | |
|---|---|---|
| Feedstock Quality Feed Components | Total VGO[1] | MVGO + LVGO |
| Endpoint ° F. | 1130 | 1000 |
| Hydrotreater reactor volume | V | <0.75V |
| Hydrotreater design presssure | P | <0.80P |

[1]LVGO + MVGO + HHVGO (not actually recovered)

As clearly evidenced in Table 2, the case which incorporates the novel features of the invention shows improved conversion selectivity to lighter products including valuable diesel boiling range material. The selectivity of naphtha plus diesel range boiling product is increased from 54% to 60%. This is achieved with less VGO yield (reduced from 46% to 40% of converted product).

As shown in Table 3, the feed to the VGO treater is greatly improved as a result of the invention. Critical $C_7$ asphaltenes are reduced to less than 200 wppm, allowing for a significant improvement in the hydrtreater/hydrocracker catalyst performance and life (cycle time–time between catalyst replacement). Additionally, the CCR and contaminant metals in the VGO treater feedstock are approximately halved as a result of the invention.

Moreover, as a result of the improved VGO feedstock, the design of the VGO treater will be less expensive since a smaller reactor volume (due to feedrate reduction and improved feed quality) and reduced design pressure will be required.

Although this invention has been described broadly and also in terms of preferred embodiments, it will be understood that modifications and variations can be made to the reactor and process which are all within the scope of the invention as defined by the following claims.

We claim:

1. A process of heavy vacuum residue conversion and vacuum gas oil treating wherein vacuum residue feedstock is first processed through a heavy oil conversion unit said process comprising:

vacuum separation of the effluent from said conversion unit to obtain a heavy, heavy vacuum gas oil (HHVGO) stream, said HHVGO stream having greater than 90% wt boiling in the 8450-1050° F. range, a light vacuum gasoil (LVGO) stream in which 90-100% wt boils below 1000° F., a medium vacuum gas oil MVGO stream, and vacuum bottoms stream, and wherein at least a portion of said LVGO and said MVGO is thereafter hydrotreated or hydrocracked and a portion of said HHVGO stream is thereafter recycled back to the heavy oil conversion unit reactor.

2. A process for atmospheric or vacuum residue conversion comprising:

a) providing atmospheric or vacuum residue to a heavy oil conversion reactor, at least 40% of said atmospheric or vacuum residue boiling above 1000° F. and said reactor operating at reaction conditions of 750°-850° F. temperature, 0.10 to 3.0 weight hourly space velocity, and 1000-3000 PSIA inlet hydrogen partial pressure and separating the effluent in a full-range ($C_5^+$) converted effluent and an unconverted residue effluent (boiling above 650° F.);

b) passing said unconverted residue to a vacuum still to separate said unconverted residue into vacuum gas oil streams comprising a light vacuum gas oil stream (LVGO), a medium vacuum gas oil stream (MVGO), a heavy, heavy vacuum gas oil stream (HHVGO), 90% of said HHVGO boiling between 850°-1050° F., and a vacuum residue stream (1050° F.+);

c) hydrotreating or hydrocracking said light vacuum gas oil stream and medium vacuum gas oil stream;

d) recycling at least a portion of said HHVGO stream along with optional unconverted vacuum residue stream to said heavy oil conversion reactor; and e) wherein said recycle of the HHVGO results in a higher yield selectivity to diesel boiling range product from the heavy oil conversion a greatly improved feedstock quality to said hydrotreater or hydrocracker, regarding to the same process without recycle of the HHVGO.

3. The process of claim 1 wherein at least a fraction of said vacuum bottoms stream is thereafter recycled to the heavy oil conversion unit.

* * * * *